United States Patent [19]

Bonnice

[11] 4,027,648

[45] June 7, 1977

[54] GRINDING WHEEL DRESSING METHOD

[75] Inventor: Phillip E. Bonnice, Worthington, Ohio

[73] Assignee: General Electric Company, Columbus, Ohio

[22] Filed: Apr. 29, 1976

[21] Appl. No.: 681,603

Related U.S. Application Data

[63] Continuation of Ser. No. 535,018, Dec. 20, 1974, abandoned.

[52] U.S. Cl. ..... 125/11 R; 51/263; 51/292

[51] Int. Cl.[2] ..... B24B 53/04

[58] Field of Search ..... 125/11 R, 11 CD; 51/263, 209, 161, 305, 306, 292

[56] References Cited

UNITED STATES PATENTS

| | | | |
|---|---|---|---|
| 2,332,992 | 10/1943 | Davis | 51/263 X |
| 2,417,800 | 3/1947 | Weisser | 51/306 X |
| 2,889,215 | 6/1959 | Nelson | 41/305 X |
| 3,314,410 | 4/1967 | Knauer | 125/11 R |

FOREIGN PATENTS OR APPLICATIONS

| | | | |
|---|---|---|---|
| 1,080,433 | 4/1960 | Germany | 125/11 CD |

OTHER PUBLICATIONS

IBM Technical Disclosure Bulletin, vol. 16, No. 5, pp. 1541–1542, "Dressing A Grinding Wheel".

*Primary Examiner*—Harold D. Whitehead
*Attorney, Agent, or Firm*—Donald J. Voss; Granville M. Pine; Edward A. Hedman

[57] ABSTRACT

A cubic boron nitride, diamond or similar grinding wheel is dressed by applying a dressing slurry comprising a multiplicity of inorganic crystals dispersed in a normally fluid carrier medium against the rotating wheel to form a layer of dressing slurry on the surface of the wheel and then pinching the slurry between the wheel and a metal piece until dressing is substantially complete.

7 Claims, 4 Drawing Figures

GRINDING WHEEL DRESSING METHOD

This is a continuation of application Ser. No. 535,018, filed Dec. 20, 1974, and now abandoned.

This invention relates to a method for dressing abrasive-containing grinding wheels.

BACKGROUND OF THE INVENTION

In machine grinding operations, it is necessary to dress the face of the grinding wheel to assure the proper shape of the part to be ground (the workpiece) and to prepare or restore the surface of the grinding wheel to optimize its cutting ability and to insure that the quality of the finish imparted to a workpiece is high.

Conventionally, grinding wheels are dressed with a variety of tools, such as steel cutters, abrasive wheels, or techniques such as crush dressing are used. One means for dressing wheels in the past comprises using a rigid stick of abrasive material bonded in a hard matrix. These depend on the mechanical strength and hardness of the matrix and require continuous, forced application to break the conventional bonding material back away from the diamond, cubic boron nitride, aluminum oxide, silicon carbide or other materials used as the abrading materials in the wheels. See, for example, Abrams, U.S. Pat. No. 3,508,533.

Conventional sticks must be used with considerable force and this leads to economic losses caused by breakage and possible injury to the operator. Moreover, the force necessary with conventional sticks precludes their use in dressing form wheels, where force destroys the form.

One technique which avoids the need for rigid sticks is shown in Giardini et al., U.S. Pat. No. 3,167,893 who used a high speed fluid jet ejected against the moving grinding wheel surface. This requires a multiplicity of pumps and apparatus of a very specialized design. Another technique which avoids the need for rigid sticks is shown in Kuris et al., U.S. Pat. No. 3,123,951 who applied an ultrasonically cavitated fluid to the moving surface of the grinding wheel. This too required nonconventional apparatus which is generally too expensive for routine manufacturing use.

In general, also, the prior art methods require rather prolonged periods of time for dressing to be completed.

A new method has now been discovered which avoids all of the above-mentioned disadvantages. In addition, the method is simple enough for even experienced operators to use it; the wheels, especially larger wheels of 10 inch and greater diameter, are left free cutting and open around the entire periphery; the dressing operation can be conducted in a "hands off" fashion for safety of the operator and to reduce operator error; the procedure is adaptable to a variety of machine types, wheel and bond designs, grinding modes; the technique is capable of providing both trueing and dressing in a single operation; and much more rapid dressing is routinely achieved.

SUMMARY OF THE INVENTION

According to the present invention, a cubic boron nitride, diamond, silicon carbide, aluminum oxide, or obviously equivalent, grinding wheel is dressed by means of applying a dressing slurry comprising a multiplicity of inorganic crystals dispersed in a normally fluid carrier medium against the rotating wheel to form a layer of dressing slurry on the surface of the wheel and then pinching the slurry between the wheel and a metal piece until dressing is substantially complete. In one preferred embodiment, the wheel dressing slurry is applied by transfer from a surface layer on said metal piece. In a second preferred embodiment, the wheel dressing slurry is applied by forcing it through at least one conduit in a dressing shoe having a metal dressing face in substantially zero clearance to the wheel surface,

BRIEF DESCRIPTION OF THE DRAWINGS

The invention may be more readily understood by reference to the accompanying drawings in which.

DETAILED DESCRIPTION OF THE INVENTION

Figure 1:
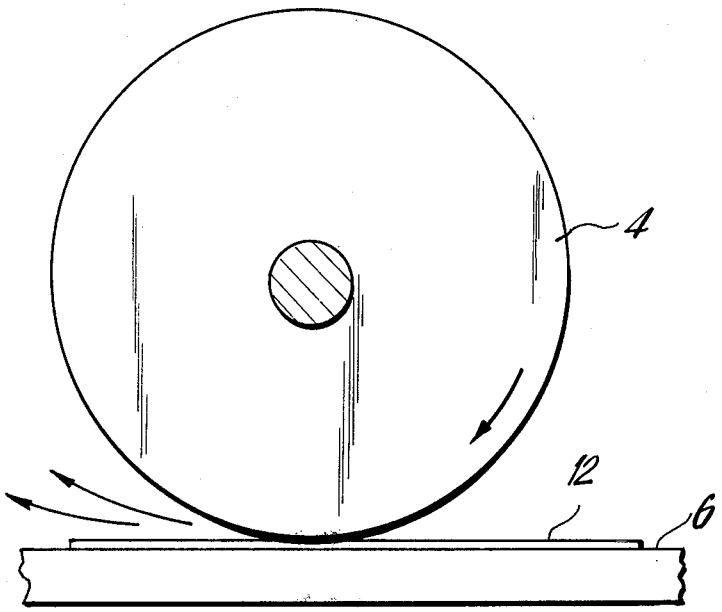
FIG. 1 is a schematic view showing dressing a wheel in a surface grinding embodiment according to this invention.

All of the following sizes, speeds and materials are illustrative only. Referring to FIG. 1, a number of dressing slurries are made by mixing aluminum oxide grit of size 60, 80, 150 and 220, into a liquid carrier medium comprising hydrocarbon-based automotive grease (Mobilux No. 2) to provide concentrations of 25, 50 and 75 weight percent, and small amounts of SAE 10 hydrocarbon oil and are spread to ⅛–3/16 inch thickness on M-2 HRC 62, 4 inch × 6 inch steel block 6. Wheel 4 comprising a 14 inch × ½ inch, 100/120 mesh cubic boron nitride abrasive surfaced wheel, 25 v/o, is mounted in a G&L No. 370, Q grinder (not shown). Wheel 4 is rotated at a 5500 SFPM speed and the table (not shown) bearing block 6 is moved at a speed of 2 ft./min., for dressing. The wheel is brought into zero clearance with block 4 and successive climb grinding passes are taken across the piece. Climb grinding, wherein the work and the wheel travel is in the same direction, is necessary to provide a "pinching" action on layer 12 of slurry. No coolant is used. By the time the wheel has traversed the 4 inch width of block, 4, the wheel is fully open. With a slurry comprising a 1:1 mix of 80 grit $Al_2O_3$ and grease, total time required is 10 minutes. Test grinding on a piece of Rene' 80 indicates an excellent finish and no burning, confirming that the wheel has been efficiently dressed.

In contrast, the use of aluminum oxide rigid stick dressers (G & K hardness sticks) fails to open the wheel even after 30 minutes.

Figure 2:
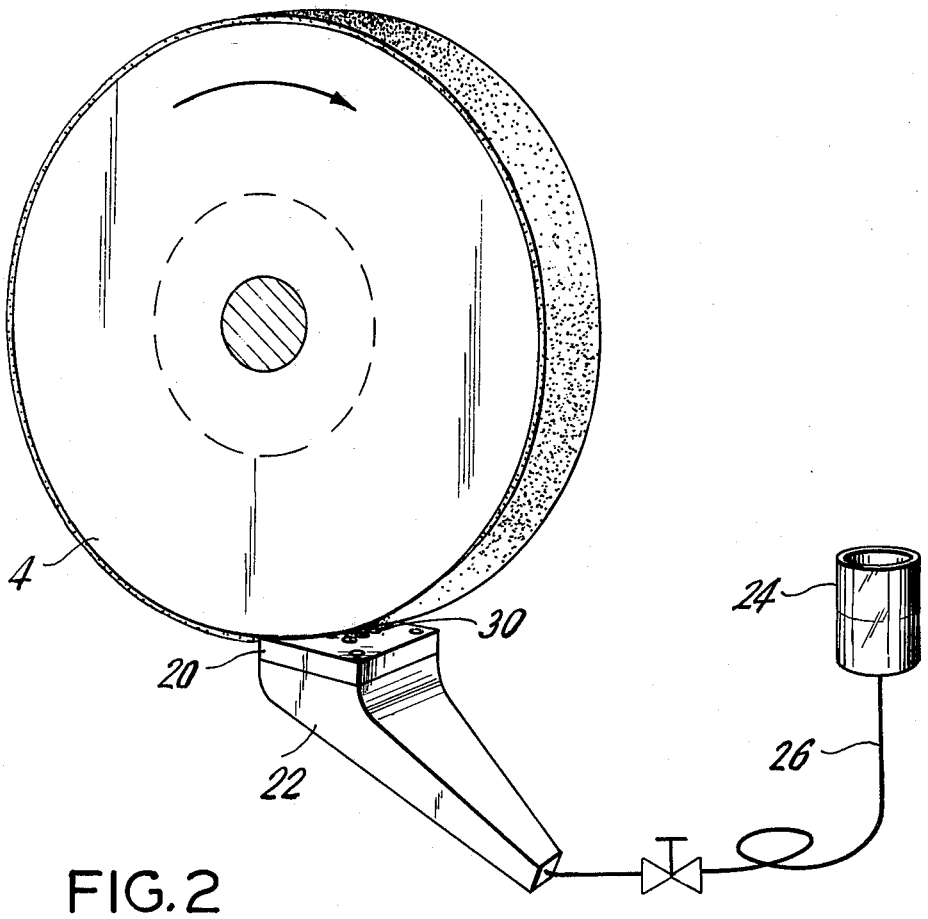
FIG. 2 is a perspective view, semi-schematic in nature of a grinding wheel and dressing shoe for application of a dressing slurry according to this invention.
Figure 4:
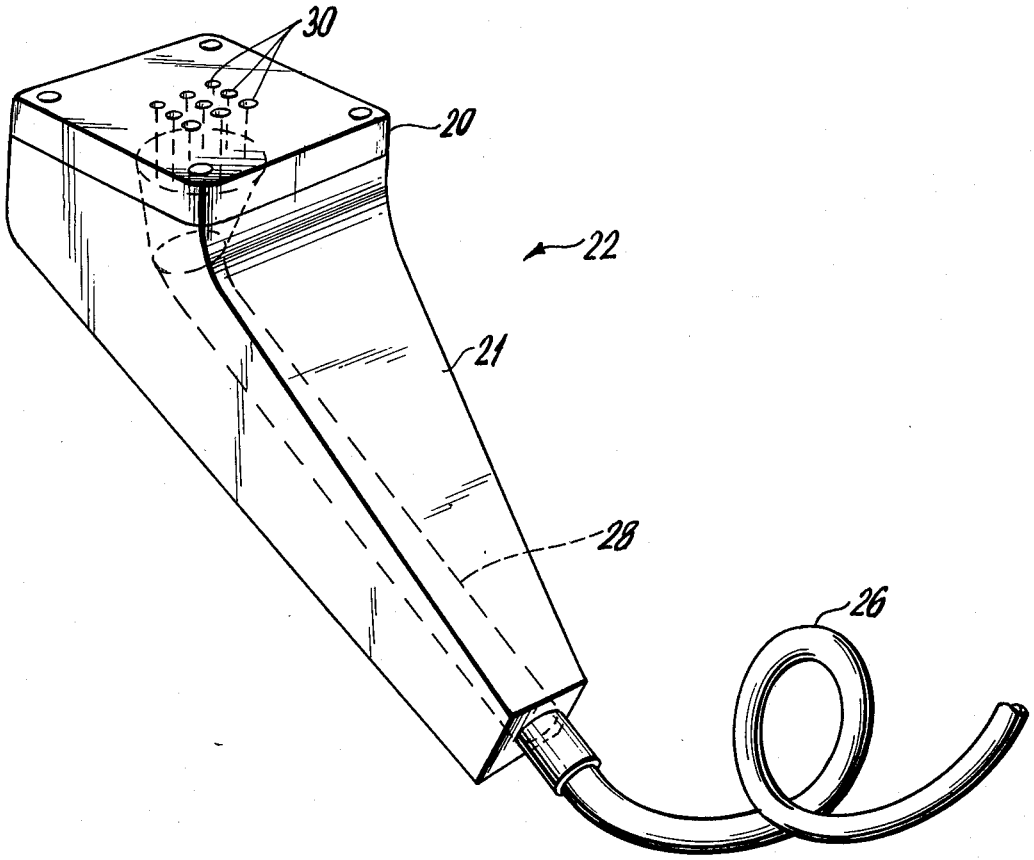
FIG. 4 shows, in greater detail, a dressing shoe of the type illustrated in FIG. 2.

Another means of practicing the invention as an alternative to surface grinding is shown in FIG. 2. As is seen, a formed metal dressing face 20 in a dressing applicator 22 is set against wheel 4. Slurry for dressing of the type described above is forced under air pressure from suitable storage reservoir 24 through a suitable conduit 26, e.g., plastic tubing to one or more holes in dressing face 20 at the leading edge of the radius to permit the slurry to enter the dressing zone. A more detailed illustration of a suitable dressing applicator 22 is shown in FIG. 4 in which body 21 is formed to fit the operator's hand, conduit 28 is bored through the handle, and the supply of slurry is adapted to pass through plastic conduit 26, bored conduit 28 and thence into the plurality of holes 30 bored through cast iron or steel dressing face 20. A suitable hole 30 diameter is 1/16 inch.

Figure 3:
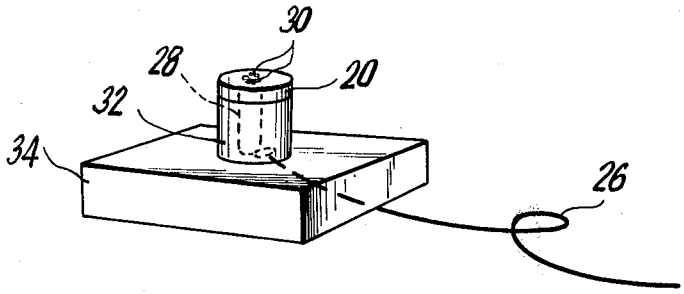
FIG. 3 illustrates an alternate design of a dressing shoe adapted for rigid mounting to a grinder table.

The apparatus according to FIGS. 2 and 3 comprised a 12 inch × 1 inch, 25 v/o, 80/100 boron nitride wheel, mounted in a G & L 370 Q grinder and operated with a wheel speed of 5500 SFPM. The slurry is a 1:1 mix of 60 grit $Al_2O_3$ in hydrocarbon grease (Mobilux No. 2). The block 20 in dressing applicator 22 is fabricated from nodular cast iron, 65 Brinell hardness.

Wheel 4 is first trued with a diamond nib and is completely glazed prior to start of dressing. The grinder is set to traverse across the block slowly allowing overlap on each side of about ½ wheel width.

The wheel is found to be fully open after 5 minutes, but observation was that this could probably have been done in half that time.

A comparison dressing test (with the same wheel after re-trueing and glazing) was made using an aluminum oxide stick of 'G' hardness 220 grit, followed by a 'K' hardness 220 grit stick. The 'G' stick is consumed in 5 minutes, and the 'K' stick is 75% consumed in 15 minutes. The wheel appears moderately open after this 20 minute period.

Grinding results using wheels dressed according to this invention in terms of spindle power and surface finish are set forth in Table I:

Table I

Grinding Power Requirements and Surface Finish

| Downfeed (by hand) | Spindle Power (KW) | | Surface Finish (AA) | |
|---|---|---|---|---|
| | Stick | Slurry | Stick | Slurry |
| .001 | 2.0 | .3 | | |
| .002 | 2.8 | 1.1 | 15 | 60 |

It is seen that the slurry dressed wheel according to this invention is superior in providing exceptionally low power draw and rough surface finish. This strongly suggests that some crystal loss at the surface may have occurred in the slurry dressed wheel and demonstrates the ability to true as well as dress in a single operation.

In another embodiment, adapted for cylindrical grinding of large wheels, the slurry is fed through a device which can be rigidly mounted on a grinder. For example, it can be mounted in the existing machine nib holder. One such unit is illustrated in FIG. 3 and comprises mounting plate 34, extension 32, wear plate 20, conduit 28 and holes 30. The perforated plate 20 is reovable so that it can be replaced when necessary. The unit can also accommodate a resin bonded diamond nib as a trueing tool when forming the wheel is to be a first step.

In using a rigidly mounted dressing fixture, abrasive is delivered from a pressurized reservoir, like that shown in FIG. 2. In one method, a 16 inch × 2 inch cubic boron nitride abrasive wheel, 80/100 mesh, 25 v/o is mounted in a grinder (Cincinnati Cylindrical) and rotated at 5500 SFPM. A slurry of 1:1 mix 120 grit $Al_2O_3$ in grease (Mobilux No. 2) is fed at 10 psi, against nib 30 mounted through plate 34 on a table (not shown) moving at 2 ft./min. Dressing face 20 comprises 1020 steel HRB 24.

Light infeeds are taken by hand at first to grind a contour into the plate 20. Plate 20 is set to overshoot the wheel about ½ diameter. The machine is then put into the automatic mode and infeed 0.001 inch at both sides of the wheel; slurry feed is minimal. This is continued until 0.075 inch infeed is made then shifted to 0.002 inch infeed per pass. Slurry flow too is increased. This is maintained for 0.080 to 0.100 inch infeed, and noticeable sparking is seen to occur. Infeed is then stepped up again to 0.003 inch per pass and continued to 0.080 inch. The wheel and plate 20 are then inspected. The wheel is found to be fully open, based on visual appearance, and photomicrographs confirm this. The face plate 20 is about ⅔ used up and only half (about 150 cc.) of the slurry is used. Total time for complete dressing is 4 minutes.

For comparison, the wheel is again glazed and dressed instead with rigid 'G' and 'K' dressing sticks. Total dressing time required is 45 minutes.

To further illustrate the efficiency of dressing grinding wheels according to this invention, the procedure described above with reference to the surface dressing embodiment of FIG. 1 is repeated with variety of dressing compositions then power requirements and surface finishes are measured during and after grinding at a wheel speed of 5500 SFPM, a table speed of 50 ft./min.; 0.100 inch crossfeed; and 0.002 inch downfeed. The results are set forth in Table 2:

Table 2

Grinding Power Requirements and Surface Finish

| $Al_2O_3$ Grit Size | Concentration w/o | KW 1st Pass* | Max. KW Entire Test | KW Last Pass | Total Watt-Hours | Final AA |
|---|---|---|---|---|---|---|
| 60 | 25 | 3.0 | 3.0 | 2.0 | 114 | 34 |
| " | 50 | 2.0 | 2.2 | 2.0 | 109 | 19 |
| " | 75 | 1.5 | 1.5 | 1.2 | 74 | 50 |
| 150 | 25 | — | — | — | — | — |
| " | 50 | — | — | — | — | — |
| " | 75 | 1.7 | 2.9 | 2.6 | 118 | 17 |
| 220 | 25 | — | — | — | — | — |
| " | 50 | — | — | — | — | — |
| " | 75 | 4.3 | 4.3 | 3.0 | 185 | 18 |

*The 25 and 50% levels of the finer grit size are omitted since preliminary trials indicated that more than one pass over the slurry will be necessary to open the wheel The KW Hour figure indicates wheel openness. The lower the number, the more open the wheel. These results indicate that the best compromise for this mesh size wheel (100/120) is found with the 150 grit $Al_2O_3$ grit. This gives excellent finish at a reasonable level of power drawn. Note that in the 60 grit series, there is good correlation between $Al_2O_3$ concentration and wattage. It appears that, in general, for a given cubic boron nitride mesh wheel, e.g., a 100/120 wheel (a very common size), a 120–150 grit $Al_2O_3$ at 75% concentration gives superior results. Grit size is U.S. Standard Sieve.

In one example of form grinding, a run is carried out on a 5 inch × ¼ inch resin bond wheel with a simple radius form. Slurry is spread over a block of M-2 steel which has been grooved with the wheel during earlier grinds. The glazed wheel is opened in only about 2 minutes, with no degradation of the form.

It is thus evident that the present invention provides dressing methods which are fast, efficient and convenient. Obviously, many modifications will suggest themselves to those skilled in the art in view of the above detailed description. For example, instead of automotive grease as a carrier, other thickened oils, and naturally thick oils, such as Vaseline, can be used to carry the grit particles. Instead of a cubic boron nitride abrasive wheel, other abrasives can be used, such as diamond wheels. Instead of aluminum oxide crystals, other grits can be slurried, such as cubic boron nitride, diamond, silicon carbide, and the like. Instead of 80 grit, the crystals can range from 60 to 250 grit size. Instead of a 1:1 mix ratio, other ratios of mixes can be used in the slurries, such as 0.1 to 6 parts of crystals per 1 part of carrier medium. Wheel trueing can comprise a preferred preliminary step, using a conventional wheel-forming tool. All such obvious variations are within the full intended scope of the invention as defined by the appended claims.

I claim:

1. A method of dressing a bonded, rigid grinding wheel on a high speed grinding machine comprising the steps setting the wheel against a metal piece at substantially zero clearance, rotating the wheel at normal grinding speed of the machine, applying a wheel dressing slurry comprising a multiplicity of abrasive crystals dispersed in a normally fluid carrier medium to the moving surface of said grinding wheel by forcing said wheel dressing slurry through a conduit in a dressing shoe having a metal dressing face in substantially zero clearance to said wheel surface, whereby the dressing slurry is spread on the surface of the wheel, and abrading said wheel surface having said slurry spread thereon against said metal dressing face to remove selected portions of the surface of said wheel.

2. A method as defined in claim 1 wherein said grinding wheel is a diamond grinding wheel.

3. A method as defined in claim 1 wherein said grinding wheel is a cubic boron nitride grinding wheel.

4. A method as defined in claim 1 wherein said abrasive crystals are aluminum oxide crystals.

5. A method as defined in claim 4 wherein said aluminum oxide crystals range from 60 to 1000 grit size.

6. A method as defined in claim 1 wherein said liquid carrier medium is a hydrocarbon medium of automotive grease viscosity.

7. A method as defined in claim 1 wherein said wheel dressing slurry has a paste-like consistency, comprises a multiplicity of 60 to 250 grit aluminum oxide crystals dispersed in a hydrocarbon automotive grease at a mix ratio of 0.1 to 6 parts by volume of crystals per 1 part by volume of said grease.

* * * * *